US005956553A

United States Patent [19]

Park

[11] Patent Number: 5,956,553

[45] Date of Patent: Sep. 21, 1999

[54] ROLLER SEPARATING APPARATUS FOR LASER PRINTER

[75] Inventor: Moon-bae Park, Suwon, Rep. of Korea

[73] Assignee: Samsung Electronics Co., Ltd., Kyungki-do, Rep. of Korea

[21] Appl. No.: 09/116,238

[22] Filed: Jul. 16, 1998

[30] Foreign Application Priority Data

Aug. 28, 1997 [KR] Rep. of Korea ..... 97-42087

[51] Int. Cl.[6] ..... G03G 15/16

[52] U.S. Cl. ..... 399/307; 399/308

[58] Field of Search ..... 399/110, 162, 399/164, 302, 307, 308, 313, 328, 335, 330, 298

[56] References Cited

U.S. PATENT DOCUMENTS 5,023,667 6/1991 Negoro et al. ..... 399/317

5,051,783 9/1991 Sato ..... 399/101

*Primary Examiner*—Arthur T. Grimley
*Assistant Examiner*—Greg Moldafsky
*Attorney, Agent, or Firm*—Sughrue, Mion, Zinn, Macpeak & Seas, PLLC

[57] ABSTRACT

A roller separating apparatus for a laser printer having a transfer backup roller, a steering roller, and a driving roller around which a photoreceptor belt circulatingly travels. The roller separating apparatus includes a first frame on which the transfer backup roller is rotatably installed. First and second eccentric cams are mounted for rotation on the first frame. A transfer roller is rotatably installed on a second frame which moves with respect to the first frame via engagement with a cam surface of the first eccentric cam. A fusing roller is rotatably installed on a third frame which moves with respect to the second frame via engagement with a cam surface of the second eccentric cam.

9 Claims, 13 Drawing Sheets

ROLLER SEPARATING APPARATUS FOR LASER PRINTER

BACKGROUND OF THE INVENTION

1. Field of the Invention

The present invention relates to a roller separating apparatus for a laser printer, and more particularly, to a roller separating apparatus for a laser printer which separates rollers from one another to prevent foreign material accumulated at the seam of a circulating photoreceptor belt from being transferred to the rollers.

2. Description of the Related Art

Referring to FIGS. 1 through 3, a conventional laser printer includes a transfer backup roller 11*a*, a steering roller 11*b*, and a driving roller 11*c* arranged in a triangle. A photoreceptor belt 12 forms a closed loop which circulates around the three rollers 11*a*, 11*b*, and 11*c*. A stepped seam portion 12*a* is formed on the photoreceptor belt 12 where the ends of the photoreceptor belt are joined together. A plurality of laser scanning units (LSUs) 15 and a plurality of development units 16 are installed adjacent to the photoreceptor belt 12 between the steering roller 11*b* and the driving roller 11*c*. The LSU's direct light beams onto the photoreceptor belt 12 according to input image information, thereby forming an image area. The development units 16 fix a developer onto the image area formed by the LSUs 15, thereby developing an image.

A transfer roller 17 opposes the transfer backup roller 11*a*, such that the photoreceptor belt 12 interposes therebetween. A fusing roller 18 opposes the transfer roller 17 to rotate in contact with the transfer roller 17. When a section of the photoreceptor belt 12 carrying the image passes between the transfer roller 17 and the transfer backup roller 11*a*, the transfer roller 17 lifts the image from the photoreceptor belt 12. The image transferred to the transfer roller 17 is printed on a paper 19 passing between the transfer roller 17 and the fusing roller 18.

Foreign material 1 such as dirt and used toner accumulate on the seam portion 12*a* of the photoreceptor belt. Such foreign material 1 adheres to the transfer backup roller 11*a*, the transfer roller 17, the fusing roller 18, and eventually prints on the paper 19, thereby deteriorating the print quality. Therefore, a roller separating apparatus 20 is provided to prevent the foreign material 1 from transferring to the transfer roller 17 and the fusing roller 18.

When the seam portion 12*a* of the photoreceptor belt 12 passes between the transfer backup roller 11*a* and the transfer roller 17, the roller separating apparatus 20 separates the transfer backup roller 11*a*, the transfer roller 17, and the fusing roller 18. Thus, the foreign material 1 accumulated on the seam portion 12*a* cannot transfer onto the transfer roller 17 and the fusing roller 18.

The roller separating apparatus 20 includes a first frame 30 on which the transfer backup roller 11*a* is installed, a second frame 40 on which the transfer roller 17 is installed, and a third frame 50 on which the fusing roller 18 is installed. A first motor 21, for rotating a first shaft 22, is installed on the first frame 30. A first rotating piece 23 is installed at both ends of the first shaft 22. A first protrusion 24 is formed at an offset position from the center of rotation of the first rotating piece 23. A ring 24*a* is fitted around the first protrusion 24 and freely rotates thereabout. The ring 24*a* is coupled to the second frame 40 by a first spring 25.

A second motor 41, for rotating a second shaft 42, is installed on the third frame 50. A second rotating piece 43 is installed at both ends of the second shaft. A second protrusion 44 is formed at an offset position from the center of rotation of the second rotating piece 43. The second protrusion 44 inserts into a hole 44*a* formed in the second frame 40. Also, a second spring 55 is installed between the second frame 40 and the third frame 50.

When the seam portion 12*a* passes between the transfer backup roller 11*a* and the transfer roller 17, the second motor 41 rotates the second rotating piece 43. The second protrusion 44 of the second rotating piece 43 moves downward and elevates the third frame 50. Thus, the fusing roller 18 separates from the transfer roller 17, as shown in FIG. 3. Next, the first motor 21 rotates the first rotating piece 23. The first protrusion 24 moves upward and elevates the second frame 40. Thus, as shown in FIG. 3, the transfer roller 17 separates from the transfer backup roller 11*a*.

While the rollers 11*a*, 17, and 18 are separated, the seam portion 12*a* of the photoreceptor belt 12 passes across the transfer backup roller 11*a*. The photoreceptor belt 12 does not contact the transfer roller 17. Thus, the foreign material 1 accumulated on the seam portion 12*a* is not transferred to the transfer roller 17.

After the seam portion 12*a* passes between the transfer backup roller 11*a* and the transfer roller 17, the first and second motors 21, 41, respectively, are driven in a reverse direction. The transfer roller 17 and the fusing roller 18 sequentially move toward the transfer backup roller 11*a*. Accordingly, the transfer backup roller 11*a*, the transfer roller 17, and the fusing roller 18 are positioned adjacent each other.

Although generally thought to be acceptable, the conventional roller separating apparatus 20 is not without shortcomings. In particular, two motors 21, 41 and their accompanying gears are required to separate the transfer roller 17 from the transfer backup roller 11*a* and the fusing roller 18 from the transfer roller 17, respectively. Thus, the structure of the roller separating apparatus 20 is complicated.

SUMMARY OF THE INVENTION

An object of the present invention is to provide a roller separating apparatus for a laser printer having a simplified structure.

Accordingly, an improved roller separating apparatus is provided for a laser printer having a photoreceptor belt which forms a closed loop for circulating travel around a transfer backup roller, a steering roller, and a driving roller. The photoreceptor belt has a seam portion formed where the ends of the photoreceptor belt overlap to form a closed loop. A first frame, on which the transfer backup roller is rotatably installed, has first and second eccentric cams which rotate when driven by a motor. A transfer roller, for receiving an image from the photoreceptor belt, is rotatably installed on a second frame. The second frame allows the transfer roller to selectively contact or separate from the photoreceptor belt via engagement with a cam surface of the first eccentric cam. A fusing roller, for pressing a paper inserted against the transfer roller, is rotatably installed on a third frame. The third frame allows the fusing roller to selectively contact or separate from the transfer roller via engagement with a cam surface of the second eccentric cam.

The above and other features of the invention including various and novel details of construction and combination of parts will now be more particularly described with reference to the accompanying drawings and pointed out in the claims. It will be understood that the particular roller separating apparatus embodying the invention is shown by way of illustration only and not as a limitation of the invention. The principles and features of this invention may be employed in varied and numerous embodiments without departing from the scope of the invention.

DETAILED DESCRIPTION OF THE INVENTION

Figures 1A, 1B:
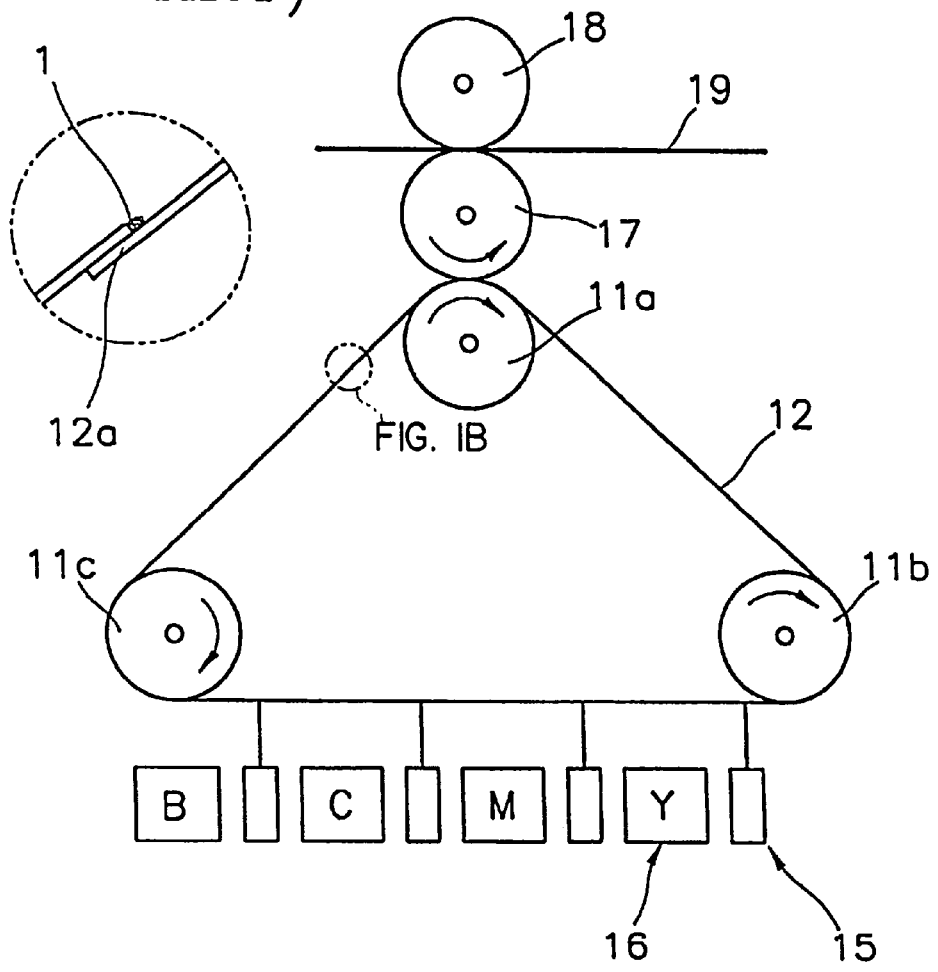
FIG. 1A (PRIOR ART)
FIG. 1B (PRIOR ART)
FIG. 1 is a schematic showing of a laser printer employing a conventional roller separating apparatus.
Figure 2:
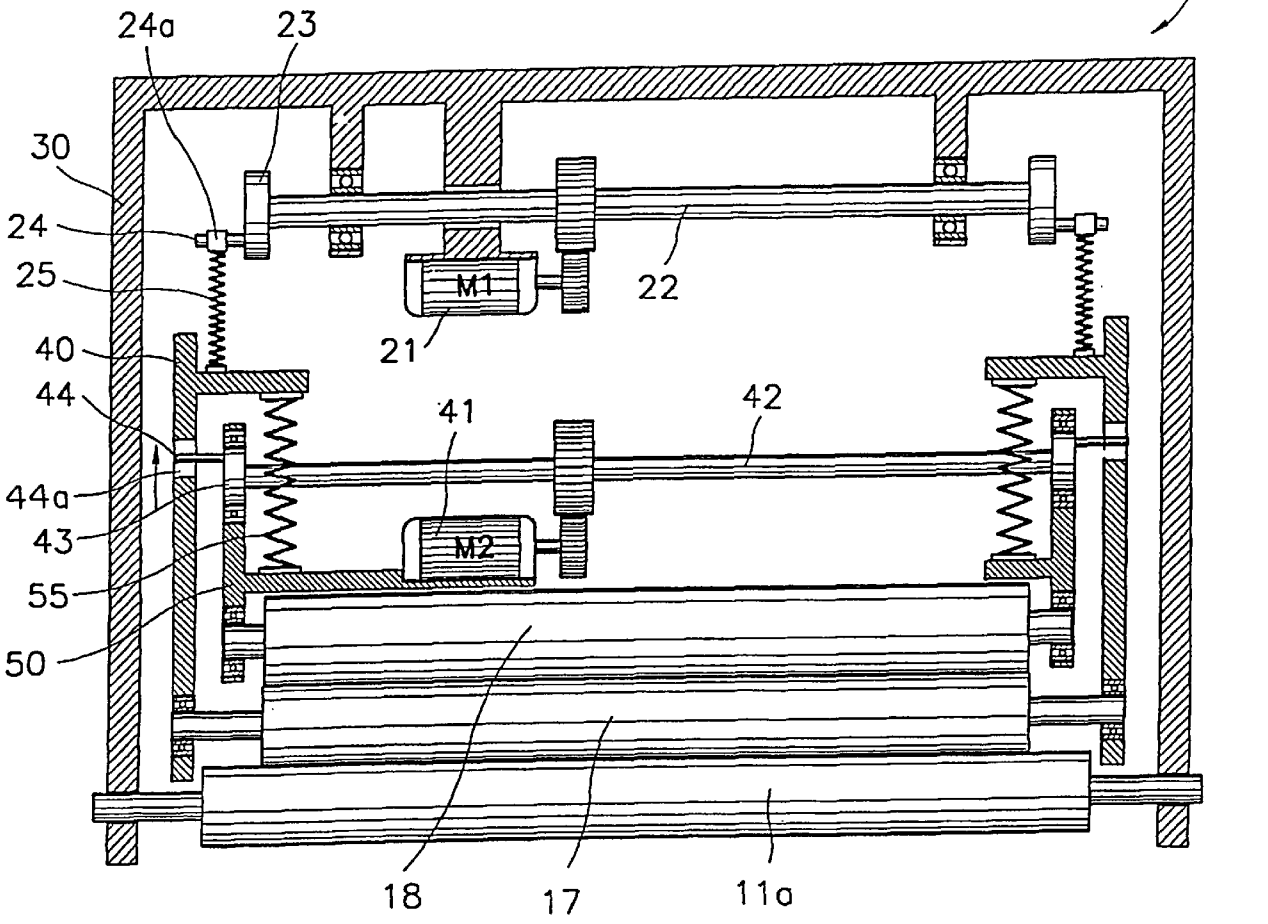
FIG. 2 (PRIOR ART)
FIG. 2 is a sectional view of a conventional roller separating apparatus.
Figure 3:
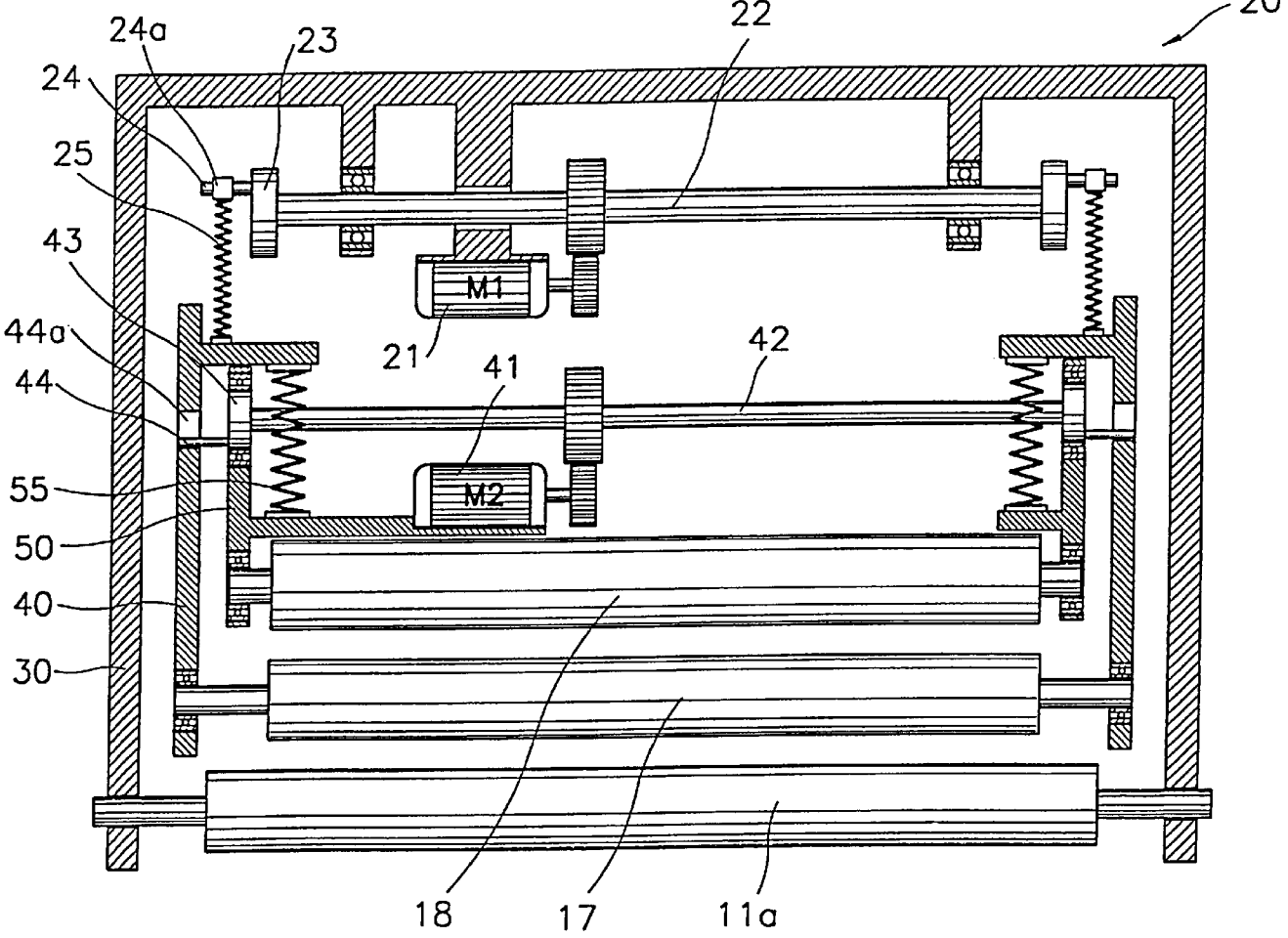
FIG. 3 (PRIOR ART)
FIG. 3 is a sectional view of the conventional roller separating apparatus in which the rollers are separated from one another.
Figures 4A, 4B:
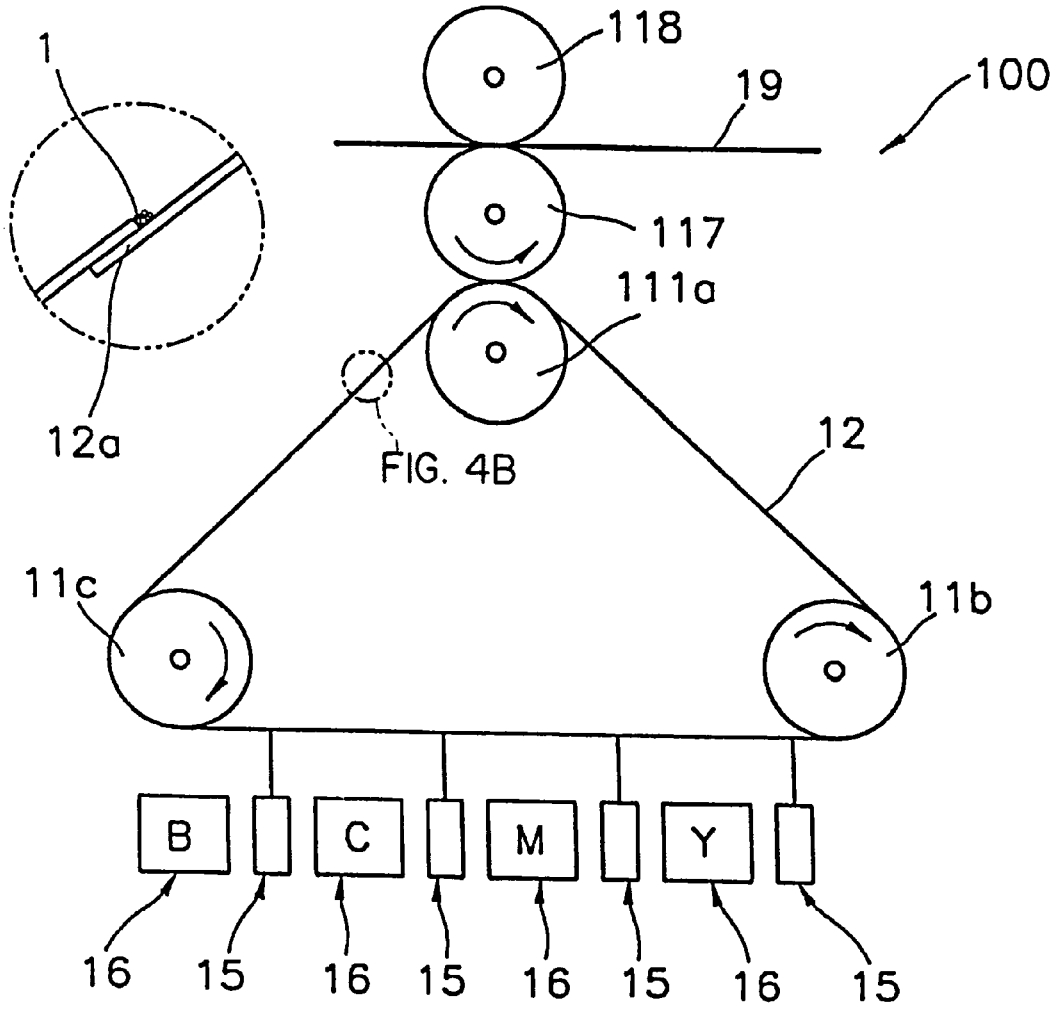
FIG. 4 is a schematic showing of a laser printer employing a roller separating apparatus according to the present invention.

FIG. 4 shows the structure of a laser printer 100 with a roller separating apparatus according to 100 the present invention. Component parts which are the same as those illustrated in FIG. 1 are designated by the same reference numerals.

The laser printer 100 includes a transfer backup roller 111*a*, a steering roller 11*b*, and a driving roller 11*c*. A photoreceptor belt 12 forms a closed loop around the rollers 111*a*, 11*b*, and 11*c* and circulates thereabout. The photoreceptor belt 12 has a stepped seam portion 12*a* which is formed where the end portions of the photoreceptor belt overlap. A plurality of laser scanning units 15 and a corresponding number of developing units 16 are installed adjacent to the photoreceptor belt 12 between the steering roller 11*b* and the driving roller 11*c*. The developing units 16 respectively contain yellow (Y), magenta (M), cyan (C), and black (B) developers.

A transfer roller 117 is installed above the transfer backup roller, such that the photoreceptor belt 12 interposes therebetween. When the transfer backup roller 111*a* and the transfer roller 117 are positioned adjacent each other, an image on the photoreceptor belt 12 is transferred to the transfer roller 117. The image transferred to the transfer roller 117 is again transferred to a paper 19 passing between the transfer roller 117 and the fusing roller 118 while the transfer roller and the fusing roller rotate together.

A roller separating apparatus 200 accommodates the rollers 111*a*, 117, and 118, to prevent the transfer of a foreign material 1 from the seam portion 12*a* of the photoreceptor belt 12 to the transfer roller 117 and the fusing roller 118. Specifically, when the seam portion 12*a* of the photoreceptor belt 12 passes between the transfer backup roller 111*a* and the transfer roller 117, the roller separating apparatus 200 separates the transfer backup roller 111*a*, the transfer roller 117, and the fusing roller 118 from one another. Thus, the seam portion 12*a* moves across the transfer backup roller 111*a*, without contacting the transfer roller 117.

Figure 5:
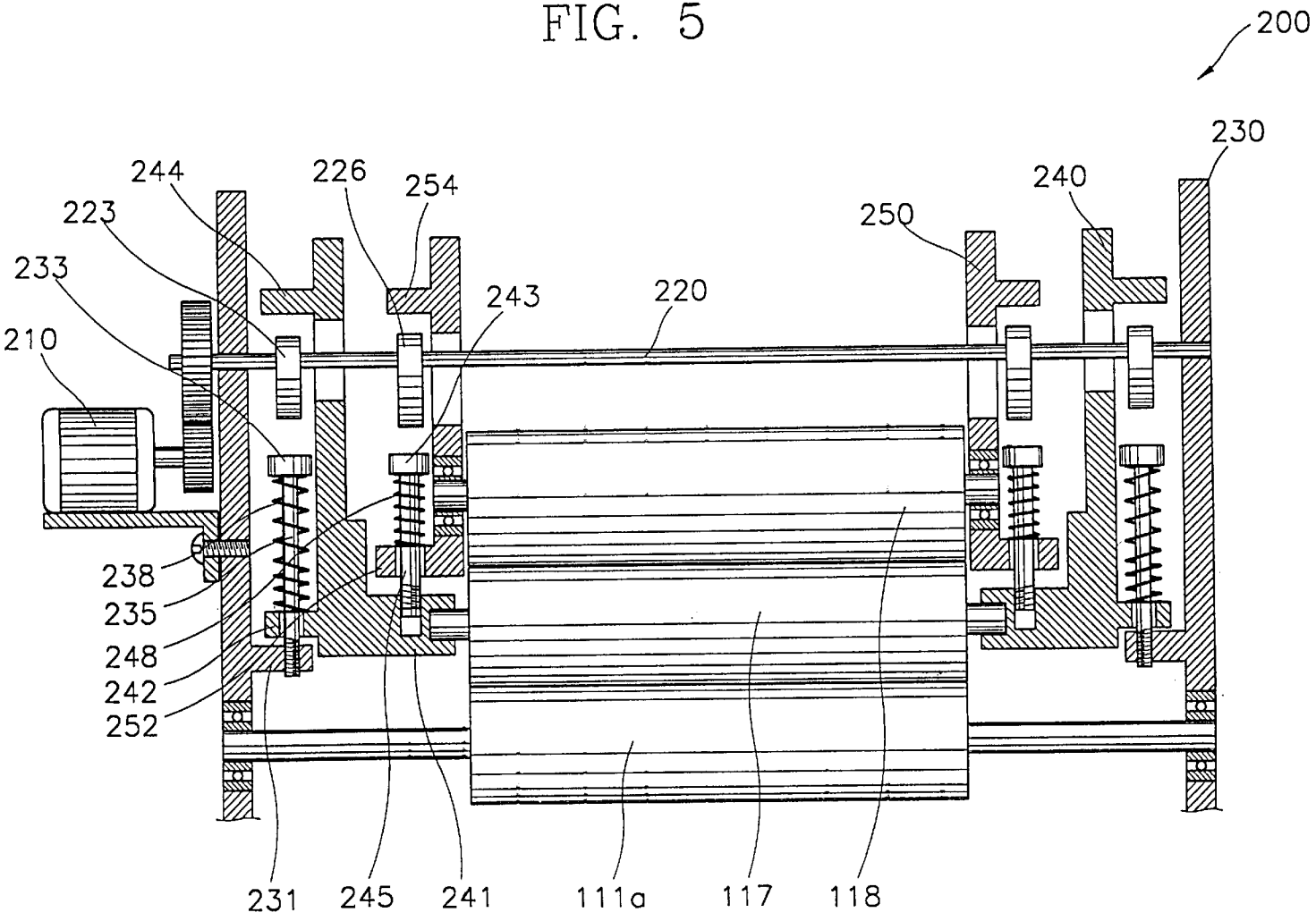
FIG. 5 is a sectional view of the roller separating apparatus according to the present invention.
Figure 6:
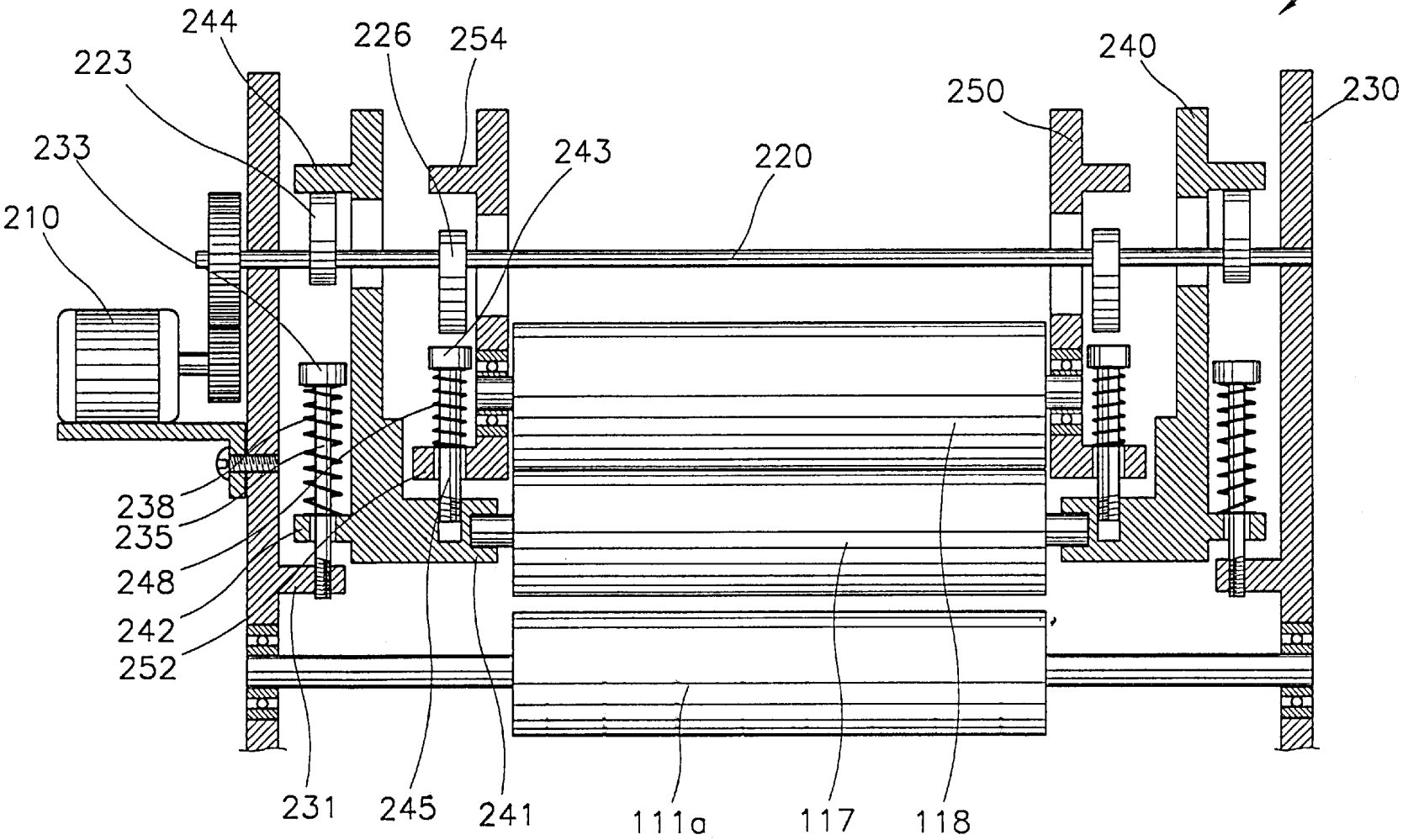
FIG. 6 is a sectional view of the roller separating apparatus shown in FIG. 5 in which the transfer backup roller and the transfer roller are separated from each other.
Figure 7:
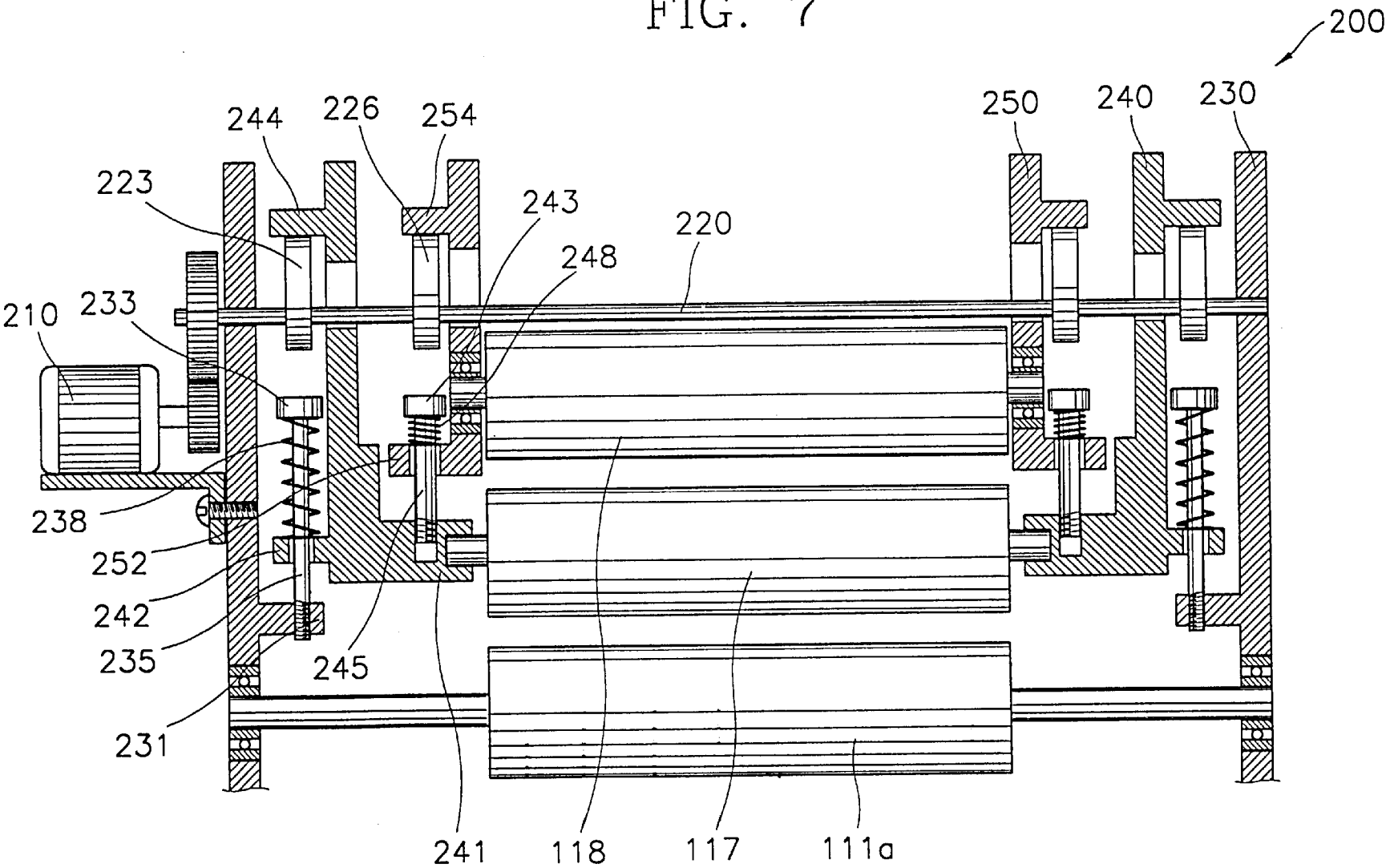
FIG. 7 is a sectional view of the roller separating apparatus shown in FIG. 5 in which the transfer backup roller, the transfer roller, and the fusing roller are separated from one another.

As shown in FIGS. 5 through 7, the roller separating apparatus 200 includes a first frame 230 on which the transfer backup roller 111*a* is rotatably installed, a second frame 240 on which the transfer roller 117 is rotatably installed, and a third frame 250 on which the fusing roller 118 is rotatably installed. The second frame 240 is moveable with respect to the first frame 230, and the third frame is moveable with respect to the second frame 240.

Figure 8:
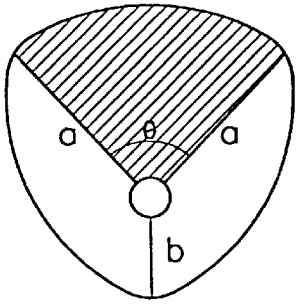
FIG. 8 is a schematic showing of a long radius and a short radius of an eccentric cam of the roller separating apparatus shown in FIG. 5.

A motor 210 mounted on the first frame 230 rotatably drives a shaft 220 penetrating through the first frame 230. A first eccentric cam 223 and a second eccentric cam 226 are installed on the shaft 220. As shown in FIG. 8, the first and second eccentric cams 223 and 226 have a long radius a and a short radius b. The length of the long radius a remains constant within a predetermined section spanning angle θ.

Figure 9A:
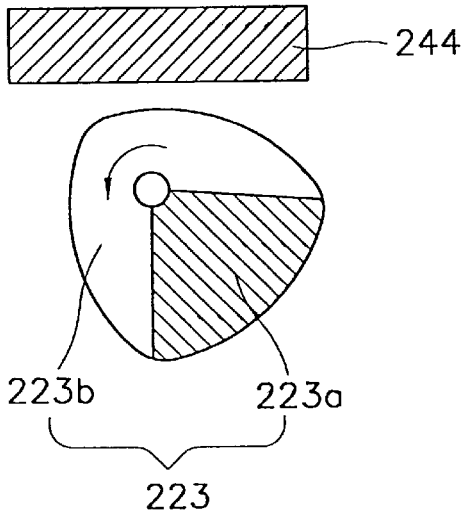
FIG. 9*a* is a schematic showing of a cam surface of the short radius section of the first eccentric cam facing a second contact step.
Figure 9B:
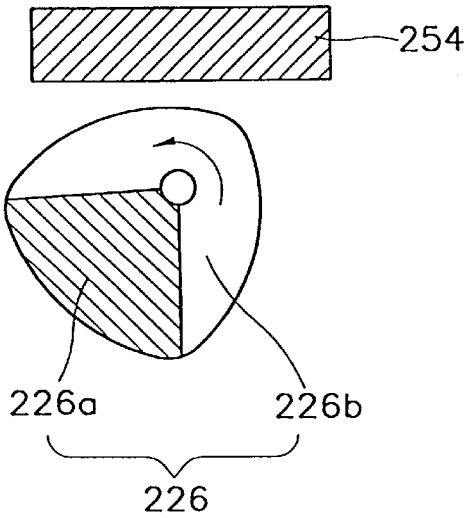
FIG. 9*b* is a schematic showing a cam surface of the short radius section of the second eccentric cam facing the third contact step.

As shown in FIG. 9*a*, the first eccentric cam 223 includes a long radius section 223*a* having the long radius a within the predetermined angle θ, and a short radius section 223*b* which is the remaining portion of the first eccentric cam 223. As shown in FIG. 9*b*, the second eccentric cam 226 includes a long radius section 226*a* having the long radius, and a short radius section 226*b* which is the remaining portion of the second eccentric cam 226. The first and second eccentric cams 223 and 226 are fixed to the shaft 220 in an offset fashion.

Referring to FIGS. 5 through 7, a first fixed step 231 protrudes from a surface of the lower portion of the first frame 230. The first fixed step 231 is screw-coupled to a first support shaft 235 which penetrates through a second support step 242 of the second frame 240. A first head 233 having a groove (not shown) for inserting the tip of a screw driver (not shown) is provided on top of the first support shaft 235. A first spring 238 inserted between the second support step 242 and the first head 233 applies an elastic force to the second support step 242. Thus, the transfer roller 117 is elastically biased toward the transfer backup roller 111*a*. Using a tool, such a screw driver, the first support shaft 235 can be rotated, thereby adjusting the distance between the first head 233 and the second support step 242. In this way, the elastic force of the first spring 238 influencing the second frame 240 can be adjusted.

A second fixed step 241 and the second support step 242 are provided at the lower portion of the second frame 240. The second fixed step 241 is screw-coupled to a second support shaft 245 which penetrates through a third support step 252 of the third frame 250. A second head 243 having a groove (not shown) for inserting the tip of a screw driver (not shown) is provided on top of the second support shaft 245. A second spring 248 inserted between the third support step 252 and the second head 243 applies an elastic force to the third support step 252. Thus, the fusing roller 118 is elastically biased toward the transfer roller 117. Using a tool, such a screw driver, the second support shaft 245 can be rotated to adjust the distance between the second head 243 and the third support step 252. In this way, the elastic force of the second spring 248 influencing the third frame 250 can be adjusted.

A second contact step 244 extending from the upper portion of the second frame 240 selectively contacts the cam surface of the first eccentric cam 223. When the first eccentric cam 223 rotates, the cam surface of the long radius section 223*a* lifts the second contact step 244. Accordingly, the second frame 240 moves against the influence of the first spring 238, and the transfer roller 117 separates from the transfer backup roller 111*a*. As the first eccentric cam 223 rotates further, the cam surface of the short radius section 223*b* faces the second contact step 244. Accordingly, the elastic force of the first spring 238 influences the second support step 242 toward the first fixed step 231, such that the transfer roller 117 is positioned adjacent to the transfer backup roller 111*a*.

The third support step 252 is provided at the lower portion of the third frame 250. The second support shaft 245 penetrates through the third support step 252 and is fixed to the second fixed step 241. A third contact step 254 extending from the upper portion of the third frame 250 selectively contacts the cam surface of the second eccentric cam 226. As the second eccentric cam 226 rotates, the cam surface of the long radius section 226*a* lifts the third contact step 254. Accordingly, the third frame 250 moves against the influence of the second spring 248, and the fusing roller 118 separates from the transfer roller 117. As the second eccentric cam 226 rotates further, the cam surface of the short radius section 226*b* faces the third contact step 254. Accordingly, the elastic force of the second spring 248 influences the third support step 252 toward the second fixed step 241, such that the fusing roller 118 is positioned adjacent to the transfer roller 117.

The operation of the roller separating apparatus having the above structure will now be described with reference to the accompanying drawings.

Figure 10:
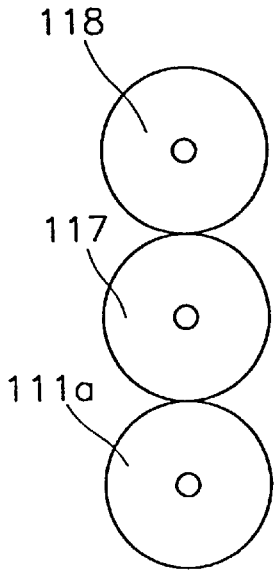
FIG. 10 is a schematic showing of the relative positions of transfer backup roller, the transfer roller, and the fusing roller corresponding to the first and second eccentric cams having the orientations shown in FIGS. 9*a* and 9*b*, respectively.

As shown in FIGS. 4 and 10, the photoreceptor belt 12 having a predetermined image area formed thereon passes between the transfer backup roller 111*a* and the transfer roller 117. When the transfer roller 117 contacts the photoreceptor belt 12, the transfer roller 117 lifts the image from the photoreceptor belt 12. As the paper 19 passes between the transfer roller 117 and the fusing roller 118, the image on the transfer roller 117 is printed on the paper 19. Here, the cam surface of the short radius section 223*b* of the first eccentric cam 223 faces the second contact step 244 as shown in FIG. 9*a*, and the cam surface of the short radius section 226*b* of the second eccentric cam 226 faces the third contact step 254 as shown in FIG. 9*b*. In such a state, the first spring 238 applies an elastic force to the second frame 240 so that the transfer roller 117 is positioned adjacent to the transfer backup roller 111*a*. Similarly, the second spring 248 applies an elastic force to the third frame 250 so that the fusing roller 118 is positioned adjacent to the transfer roller 117.

When the seam portion 12*a* of the photoreceptor belt 12 passes between the transfer backup roller 111*a* and the transfer roller 117, a sensor (not shown) detects the seam portion 12*a* to generate a signal for driving the motor 210. As the motor 210 is driven, the transfer backup roller 111*a*, the transfer roller 117, and the fusing roller 118 separate from one another.

Figure 11A:
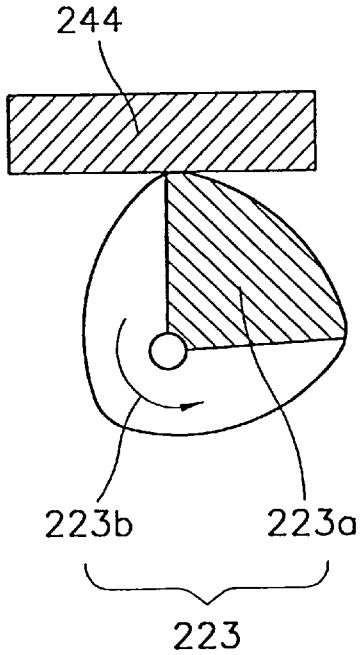
FIG. 11*a* is a schematic showing of a cam surface of the long radius section of the first eccentric cam in contact with the second contact step.
Figure 11B:
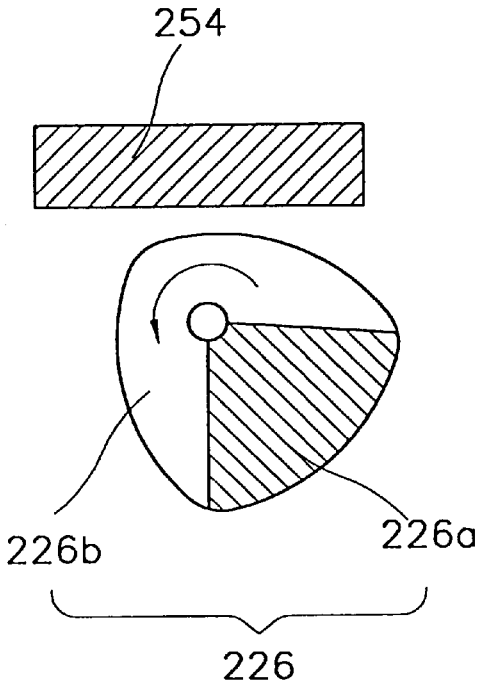
FIG. 11*b* is a schematic showing of a cam surface of the short radius section of the second eccentric cam facing the third contact step.
Figure 12:
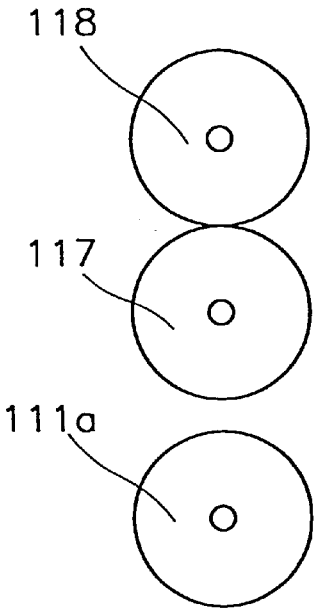
FIG. 12 is a schematic showing of the relative positions of the transfer backup roller, the transfer roller, and the fusing roller corresponding to the first and second eccentric cams having the orientations shown in FIGS. 11*a* and 11*b*, respectively.

The motor 210 rotationally drives the shaft 220, along with the first and second eccentric cams 223 and 226. Initially, the cam surface of the long radius section 223*a* of the first eccentric cam 223 contacts and lifts the second contact step 244 (FIG. 11*a*), while the cam surface of the short radius section 226*b* of the second eccentric cam 226 faces the third contact step 254 (FIG. 11*b*). As a result, the transfer roller 117 and the fusing roller 118 move together, in a direction away from the transfer backup roller 111*a*. As shown in FIGS. 6 and 12, the transfer backup roller 111*a* and the transfer roller 117 are separated from each other, and the transfer roller 117 and the fusing roller 118 remain is close proximity with respect to each other.

Figure 13A:
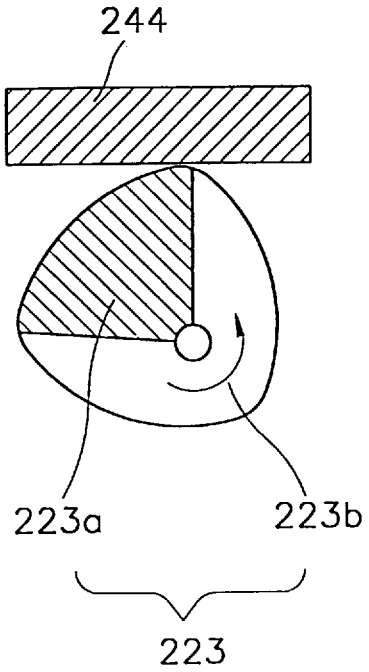
FIG. 13*a* is a schematic showing of a cam surface of the long radius section of the first eccentric cam in contact with the second contact step.
Figure 13B:
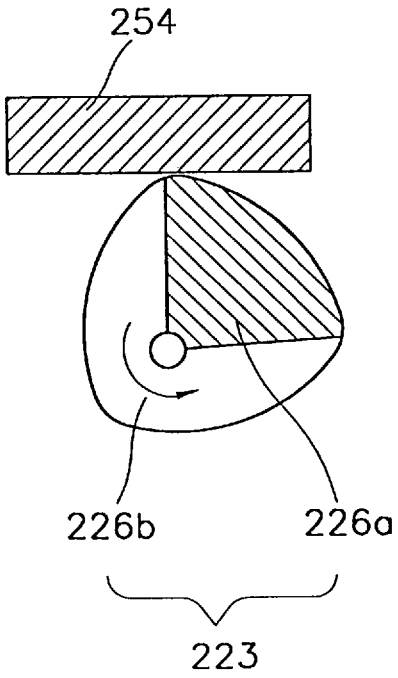
FIG. 13*b* is a schematic showing of a cam surface of the long radius section of the second eccentric cam in contact with the third contact step.
Figure 14:
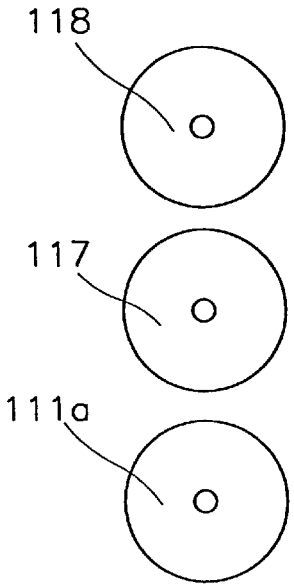
FIG. 14 is a schematic showing of the relative positions of the transfer backup roller, the transfer roller, and the fusing roller corresponding to the first and second eccentric cams having the orientations shown in FIGS. 13*a* and 13*b*, respectively.

When the shaft 220 is further rotated by the motor 210, the cam surface of the long radius section 223*a* of the first eccentric cam 223 slides along the second contact step 244. Thus, the second contact step 244 remains in a lifted state (FIG. 13*a*). Meanwhile, the cam surface of the long radius section 226*a* of the second eccentric cam 226 contacts and lifts the third contact step 254 (FIG. 13*b*). As shown in FIGS. 7 and 14, the transfer backup roller 111*a*, the transfer roller 117, and the fusing roller 118 are separated from one another.

In this condition, the seam portion 12*a* passes across the transfer backup roller 111*a*. The transfer roller 117 is separated from the transfer backup roller 111*a*, and therefore does not contact the photoreceptor belt 12. Thus, the foreign material 1 accumulated on the seam portion 12*a* cannot transfer to the transfer roller 117.

Figure 15A:
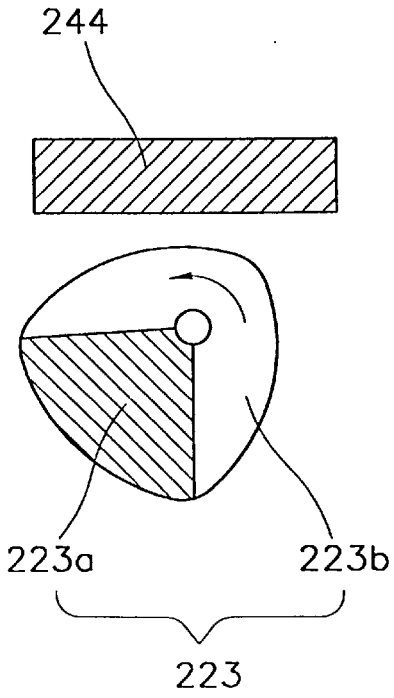
FIG. 15*a* is a schematic showing of a cam surface of the short radius section of the first eccentric cam facing the second contact step.
Figure 15B:
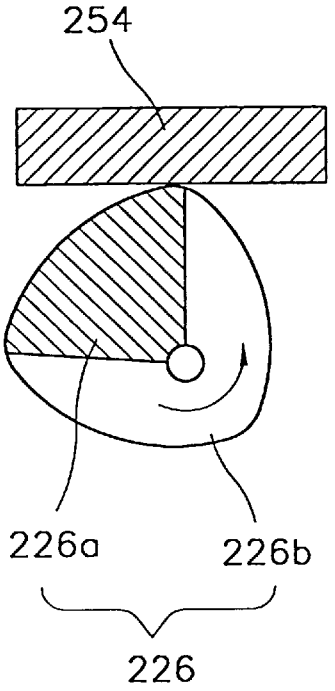
FIG. 15*b* is a schematic showing a cam surface of the long radius of the second eccentric cam in contact with the third contact step.
Figure 16:
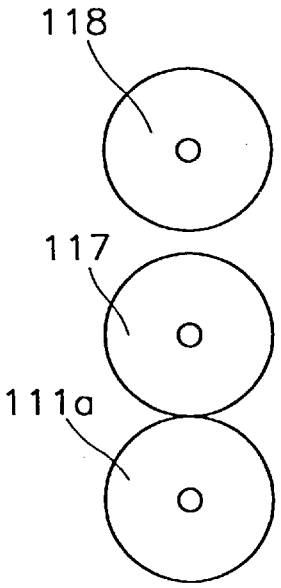
FIG. 16 is a schematic showing of the relative positions of the transfer backup roller, the transfer roller, and the fusing roller corresponding to the first and second eccentric cams having the orientations shown in FIGS. 15*a* and 15*b*, respectively.

After the seam portion 12*a* passes across the transfer backup roller 111*a*, a signal for driving the motor 210 is generated. As the shaft 220 rotates, the cam surface of the short radius section 223*b* of the first eccentric cam 223 faces the second contact step 244 (FIG. 15*a*). Thus, the transfer roller 117, influenced by the first spring 238, moves toward the transfer backup roller 111*a*. The cam surface of the long radius section 226*a* of the second eccentric cam 226 slides along the third contact step 254. Accordingly, the third contact step 254 remains in a lifted state (FIG. 15*b*). As shown in FIG. 16, the transfer backup roller 111*a* is positioned adjacent the transfer roller 117, while the transfer roller 117 and the fusing roller 118 remain separated from each other.

The motor 210 continues to rotationally drive the shaft 220, until the first and second eccentric cams 223 and 226 have been rotated 360° from their initial positions illustrated in FIGS. 9*a* and 9*b*. Accordingly, the transfer backup roller 111*a*, the transfer roller 117, and the fusing roller 118 are positioned adjacent each other so that the printer returns to a normal printing mode.

As described above, in the roller separating apparatus for a laser printer according to the present invention, the transfer backup roller, the transfer roller, and the fusing roller can be separated from one another by adopting a single motor and two eccentric cams. Thus, compared to the conventional technology, the structure of the roller separating apparatus is simplified and foreign material can be prevented from being transferred to the transfer roller.

What is claimed is:

1. A roller separating apparatus for a laser printer having a photoreceptor belt which forms a closed loop for circulating travel around a transfer backup roller, a steering roller, and a driving roller, said roller separating apparatus comprising:

a first frame on which said transfer backup roller is rotatably mounted;

a first eccentric cam and a second eccentric cam rotatably mounted on said first frame;

a second frame on which a transfer roller, for receiving an image formed on said photoreceptor belt, is rotatably mounted, said second frame moveable relative to said first frame via engagement with a cam surface of said first eccentric cam, such that said transfer roller selectively contacts said photoreceptor belt; and a third frame on which a fusing roller, for pressing a paper against said transfer roller, is rotatably mounted, said third frame moveable relative to said second frame via engagement with a cam surface of said second eccentric cam, such that said fusing roller selectively presses against said transfer roller.

2. The roller separating apparatus for a laser printer as claimed in claim 1, wherein said first frame includes a shaft mounted for rotation on said first frame, and said first and said second eccentric cams are fixed to said shaft.

3. The roller separating apparatus for a laser printer as claimed in claim 2, further including a motor for rotating said shaft.

4. The roller separating apparatus for a laser printer as claimed in claim 3, wherein said motor is mounted on one of said first, said second, and said third frames.

5. The roller separating apparatus for a laser printer as claimed in claim 2, wherein each of said first and said second eccentric cams includes a long radius section and a short radius section, said long radius and said short radius sections of said first eccentric cam being respectively offset from said long radius and said short radius sections of said second eccentric cam.

6. The roller separating apparatus for a laser printer as claimed in claim 1, further including:

a support shaft extending from said first frame and through an aperture in said second frame, such that said second frame is slidable along said support shaft between said first frame and a keeper of said support shaft; and a spring installed on said support shaft between said keeper and said second frame to elastically bias said second frame toward said transfer backup roller.

7. The roller separating apparatus for a laser printer as claimed in claim 6, wherein said support shaft is screw-coupled to said first frame so that an elastic force of said spring applied to said second frame is adjustable via rotation of said support shaft.

8. The roller separating apparatus for a laser printer as claimed in claim 1, further including:

a support shaft extending from said second frame and through an aperture in said third frame, such that said third frame is slidable along said support shaft between said second frame and a keeper of said support shaft; and a spring installed on said support shaft between said keeper and said third frame to elastically bias said third frame toward said transfer roller.

9. The roller separating apparatus for a laser printer as claimed in claim 8, wherein said support shaft is screw-coupled to said second frame so that an elastic force of said spring applied to said third frame is adjustable via rotation of said support shaft.

* * * * *